US005788223A

United States Patent [19]

Stockton

[11] Patent Number: 5,788,223

[45] Date of Patent: Aug. 4, 1998

[54] ANIMAL BARRIER

[75] Inventor: Kenneth A. Stockton, Tucson, Ariz.

[73] Assignee: Arizona Sonora Desert Museum, Tucson, Ariz.

[21] Appl. No.: 710,724

[22] Filed: Sep. 19, 1996

Related U.S. Application Data

[60] Provisional application No. 60/003,946, Sep. 19, 1995, and provisional application No. 60/003,947, Sep. 19, 1995.

[51] Int. Cl.[6] ..... E04H 17/04; B21F 27/02

[52] U.S. Cl. ..... 256/45; 256/5; 256/2; 289/1.2

[58] Field of Search ..... 289/1.2, 18.1; 428/32, 100, 175; 140/59, 101, 3 R, 3 A, 3 B, 5–7, 9–11; 256/2, 5, 8, 45; 87/53, 62, 12

[56] References Cited

U.S. PATENT DOCUMENTS

| | | | |
|---|---|---|---|
| 302,845 | 7/1884 | Hulbert | 256/5 |
| 448,455 | 3/1891 | Randall . | |
| 631,910 | 8/1899 | Swift | 256/45 |
| 711,388 | 10/1902 | Donaghy | 256/45 X |
| 1,259,869 | 3/1918 | Jackson | 140/101 |
| 2,360,416 | 10/1944 | Gray | 289/18.1 X |
| 2,390,200 | 12/1945 | York | 428/175 |
| 2,518,140 | 8/1950 | Heggland | 87/53 |
| 2,641,951 | 6/1953 | Sonnberger | 289/1.2 X |
| 2,888,854 | 6/1959 | Johnson | 289/1.2 |
| 3,227,479 | 1/1966 | Rutty | 289/1.2 |
| 3,318,623 | 5/1967 | Barroso | 289/1.5 |
| 3,400,959 | 9/1968 | Grillot | 289/2 |
| 4,008,912 | 2/1977 | Kotov | 289/1.2 |
| 5,328,310 | 7/1994 | Lockney | 289/1.2 X |

FOREIGN PATENT DOCUMENTS 693313 6/1953 United Kingdom .

OTHER PUBLICATIONS

Memphis Net & Twine Co., Inc., Memphis, Tennessee, p. 3, 1995 Catalog.

*Primary Examiner*—Anthony Knight
*Attorney, Agent, or Firm*—Robert Platt Bell & Associates, P.C.

[57] ABSTRACT

An improved animal barrier material and an improved fastening system to simplify its knotting process are disclosed. The animal barrier material comprises a see-through cable netting characterized by strong and secure knots. An improved fastening system may be employed to simplify knotting and produce superior cable connections. The improved fastening system requires only a single spool of cable to form grids for netting; its simplified knotting process does not require passing a spool of cable through any previously-tied portion of the net. The resulting cable netting provides a superior see-through netting for simultaneous containment and visual enjoyment of zoo animals.

14 Claims, 11 Drawing Sheets

ANIMAL BARRIER

CROSS-REFERENCE TO RELATED APPLICATIONS

This application claims priority from Provisional U.S. application Ser. No. 60/003,946, filed Sep. 19, 1995; and Provisional U.S. application Ser. No. 60/003,947, filed Sep. 19, 1995; both of which are incorporated herein by reference.

FIELD OF THE INVENTION

The invention described herein is related generally to meshed nettings, and is related more specifically to a meshed netting of metallic composition for fixed deployment as a see-through protective barrier.

BACKGROUND OF THE INVENTION

Zoos have sought improved barriers for containment of zoo animals with less visually-obtrusive means. The demand for less visible barriers has led to development of a number of different containment strategies. The ultimate goal of an invisible barrier has remained largely unfulfilled for zoo administrators and the general public. Some efforts have been made to achieve this goal by zoo designers working in concert with product manufacturers.

Barriers fall into one or more of the following categories: see-through fencing, including meshes of a variety of materials and descriptions, tension wire and electrified wire; barriers of transparent glass; wet and dry moats; and walls made of simulated rock. Each containment approach has advantages and is useful in certain applications, but there is still plenty of room for improvement, consequently, designers and manufacturers continue to seek new ways to satisfy the demand for better barriers.

Since fencing is usually cheaper than moats, windows, or walls, a major focus has been to develop stronger and less visible cable meshes. Cables made of metal offer many advantages as a fencing material, i.e., relatively low cost, strength, flexibility, durability, availability, etc.

The demand for cable netting has led to development of a number of different products. Consequentially, a number of different cable products have been introduced to the markets in recent years. Despite the variety of products now available, there is still a substantial need for improvement.

Turning now to cable meshes, cable meshes are produced by laying out separate cables and joining them to each other in various ways. The challenge here is to cost-effectively, aesthetically, and dependably join the cables at regular points of intersection.

One prior-art netting is comprised of 1/16" or 3/32" stainless steel cables which are joined at regular intervals with cylindrical metal fasteners which are threaded over the cables and crimped. It forms diamond-shaped openings when stretched. Such a prior-art netting may be marketed by Kettner & Associates, Inc. of Mequon, Wis. This prior-art mesh is considered quite effective for containment of mammals, such as leopards and baboons. The crimped connectors are however noticeably visible, and the cables are generally thicker than desirable for aviaries and other light-duty enclosures. The crimped meshes are also expensive to produce because the fasteners are threaded and crimped by hand.

Double tucked cable mesh is another prior-art cable mesh. It is available through Carlos' Designs of Las Vegas, Nev., as well as other mesh manufacturers. It is hand-manufactured so that the individual cables zig-zag back and forth to join alternatively, in a knotless connection, to the adjacent cable on either side. Due to the process of spreading one cable apart so the other can be threaded through the opening, this method requires relatively thick cables to permit separation of the strands.

Single-tucked and hog ringed cable mesh is another prior-art cable mesh. It is produced by International Cordage, Inc. It advantageously employs hog-rings at cable intersections for faster production. Unfortunately, the connections tend to slide, and the cable are also thick. It is relatively labor intensive to produce.

Hog-ringed cable mesh is a less expensive alternative prior-art cable mesh. The cables are advantageously connected without the involvement of threading of wires. Although this mesh is adequate to contain animals that do not place excessive force on the joints, if sufficient tension is placed on any connection, then the cables may slip through the hog rings.

Cast-metal connected cable meshes are manufactured in Germany by Pfeifer Nets. The wires are bonded at each intersection with a small cast-metal sphere, so that the sphere rigidly encases the cables. Unlike the connections on hog-ring meshes, these cast-in-place connectors do not slip. They are however, expensive to procure, very visible, and are not practical for use with fine-gauge cables.

Turning now to non-cable meshes, welded wire fabrics are available in very fine gauges. They are useful for containing birds and smaller mammals. However, the quality of the welds tends to be inconsistent, and fatigued wires may break upon repeated flexing.

A mesh known as, Phantom Mesh™, is available through A thru Consulting and Distributing, Inc. It is appropriate as a low-cost and less-visible containment barrier. It is not a cable mesh. Its design is like that of a chain link, although lighter-gauge wires are used. Although the curved and spiraled contours of the wires reduce visual reflectivity, the wires are however relatively thick and closely spaced, and tend to be noticeably visible.

Another mesh called, Zoomesh™, is machine-knitted using a fine wire to form loosely interlocking rows. It is suitable for containing smaller birds and mammals. However, due to lack of wire bonding, the knitting can be snagged. Its fine meshing is difficult to frame, yet noticeably visible to the eyes.

Poultry netting, or a chicken wire, is cheap and offers reasonable visibility, but it is weak and susceptible to breaks when considered for permanent animal housing.

Non-metallic meshes and nets are suitable for some aviary construction. However, non-metallic meshes and nets have been known to be susceptible to chewing by mammals, particularly rodents that may be preying after the feed grain. Similarly, birds are often at risk to predators when housed in aviaries constructed of synthetic materials, because predators have been known to tear and chew through non-metallic meshes and nets.

Most fishnets are non-metallic nets. They are machine tied in large quantities. The prior art net-making machines are generally intricate, expensive, and made for volume production. They are specific to handling of pliable cords for fishnets, and are not known in the industry to be readily adaptable to handling metallic cables, which are not as pliable as the cords for fishnets.

One example of a non-metallic netting is a hand-tied fishnet. This traditional hand-tying technique involves the use of an elongated netting needle. The netting needles are generally narrow. A reasonably large quantity of cord is wrapped around a netting needle. The netting is created by forming a long row of loops, to which is tied a second row of loops, and then a third, etc. The netting needles are narrow because an entire supply of cord must pass through the loop of previously tied mesh to which the new knot is being tied.

This technique of tying a net is ill-suited for modern-day purposes. The process of passing the entire supply of cord on a needle through each loop must be done by hand. Also, the amount of the available cord is limited by the size of the mesh through which the needle passes. These limitations necessitate frequent splicing of cords to produce nets of large size.

The aforementioned prior-art meshes and nets do not satisfactorily meet certain barrier use requirements where strength, see-through visibility, mesh integrity, and ease of production are all high selection criteria.

SUMMARY AND OBJECTS OF THE INVENTION

By the present invention, an improved animal barrier material and an improved fastening system to simplify its knotting process are disclosed. The animal barrier material comprises a see-through cable netting characterized by strong and secure wire-to-wire connections. An improved fastening system may be employed to simplify knotting and produce superior wire-to-wire connections.

Accordingly, one of the objects of the present invention is to provide a fine-gauge cable netting characterized by strong and secure wire-to-wire connections.

Another object of the present invention is to provide a superior see-through netting for simultaneous containment and visual enjoyment of zoo animals.

Another object of the present invention is to provide a superior see-through wire netting characterized by secure and slip-free wire-to-wire connections.

Another object of the present invention is to utilize a knotting process for connecting fine cables into a superior see-through wire netting characterized by secure and slip-free wire-to-wire connections.

Another object of the present invention is to provide an improved fastening system to effectuate a simplified knotting process for producing a superior see-through wire netting by repetitively tying one continuous cable of fine gauge originating from a single spool of cable to itself at regular intervals to form a grid or netting, which repetitive tying does not require passing a spool of cable through any previously-tied portion of the net.

Another object of the present invention is to provide an improved fastening system to effectuate a simplified knotting process for manufacturing a superior see-through wire netting which lends itself to automation of repetitively knotting a single spool of cable for mass production.

Another object of the present invention is to provide alternatively fastened nettings of fine gauges using fine, but secure, cable fasteners not prone to slippage or breakage with use.

These and other features, objects, and advantages of the present invention are described or implicit in the following detailed description of various preferred embodiments.

BRIEF DESCRIPTIONS OF THE DRAWINGS

FIG. 1 is a side view of a partially constructed improved cable netting being constructed with a single spooled cable under an improved fastening system for nets, meshes, and the like.

DETAILED DESCRIPTION OF THE INVENTION

BEST MODE DESCRIPTION

Figure 1:
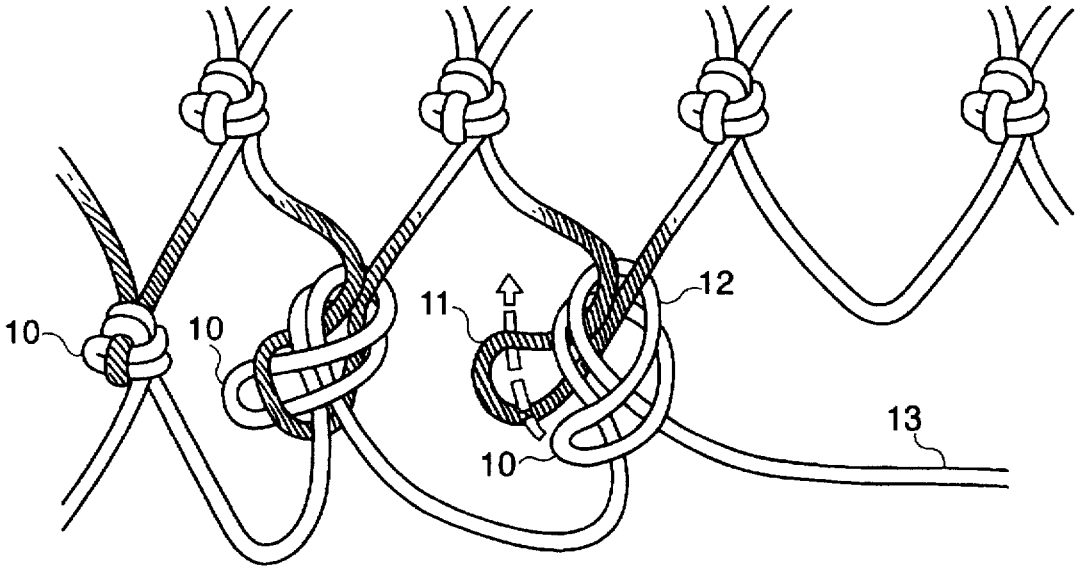

An improved animal barrier material comprising a see-through cable netting characterized by strong and secure cable (or strand) connections is disclosed, along with an improved fastening system for netting, meshes, and the like. (Here, "cable" shall refer to both a strand comprising twisted wires and also a cable comprising strands.) The cable connections are essentially cable knots achieved with the employment of the improved fastening system, which simplified knotting or tying of the basic cable material comprising the see-through cable netting.

The cable material may be a cable further comprised of a plurality of metallic wires or strands, preferably of stainless steel wires and strands. Table 1 tabulates the finer grades of cables by tensile strength. They were found suitable for various knotted cable nettings.

The utilized cables may be obtained from the Sevenstrand Tackle Corporation of Long Beach, Calif. These cables are stainless steel cables typically ranging from 1×7 to 7×7 in wire/strand compositions. However, it is entirely possible that other wire/strand mixes and other metallic compositions yielding finer gauges of cable would also be suitable for the present purposes.

TABLE 1

Table of Stainless Steel Cables.

| WIRES/STRANDS | TENSILE STRENGTH | MEAS. DIA. |
|---|---|---|
| 1 × 7 | 18 lbs. | 0.011" |
| 1 × 7 | 27 lbs. | 0.012" |
| 1 × 7 | 40 lbs. | 0.015" |
| 1 × 7 | 60 lbs. | 0.018" |
| 1 × 7 | 90 lbs. | 0.024" |
| 1 × 7 | 135 lbs. | 0.027" |
| 1 × 7 | 170 lbs. | 0.033" |
| 7 × 7 | 175 lbs. | 0.036" |
| 1 × 7 | 250 lbs. | 0.039" |

Examples of the typical mesh/cable mixes used for the presently prototyped nettings are as follows: A 2"×2" (4" stretched) meshed netting may be produced with a 60 lbs.

tensile strength 1×7 cable using simple knots and multiple spools; a smaller meshings of 1"×1" and ⅝"×⅝, " appropriate for aviaries, may use a 27 lbs. tensile strength 1×7 cable using simple knots and multiple spools; a hand-tied swivel-knot netting having 3"×3" meshes may be produced with multiple spools of either 175 lbs. tensile strength 7×7 cables or 170 lbs. tensile strength 1×7 cables. However, these mesh/knot/cable combinations are only exemplary of the best embodiment, and other matrices of mesh/knot/cable mixes are certainly within the realm of this invention.

The invention utilizes an improved fastening system for netting, meshes, and the like, which is a simplified knotting process for manufacturing a superior see-through cable netting. This process allows production of netting from a single spool of material, of any length or size, which never has to pass through a loop. It allows mesh to be tied with any size opening, large or small. Particularly with the thinner gauges, this process of using knots to connect the individual cables was found demonstrably superior to prior-art cable meshes in terms of fail-safe and low-visibility characteristics.

This improved fastening system for netting, meshes, and the like is ideally suited to development of a greatly simplified machine. Any size piece of netting can be produced, without seams, by working in a circle (spiral) with a circumference equal to the desired width of the finished netting. As each row of loops is tied to the preceding row, a cylinder of netting is produced, which, when the desired length is obtained, can be slit along one side to produce a rectangle of virtually any previously-determined size.

This improved fastening system for netting, meshes, and the like is not limited to producing nettings using metallic cables. Fine cables of any pliable cord composition may serve its purpose.

DESCRIPTION OF THE IMPROVED FASTENING SYSTEM

An improved fastening system simplifies a knotting process for netting, meshes, and the like. It involves repetitively tying one continuous flexible member, originating from one spool, to itself at regular intervals to form knots. The repetitive knots do not require passing the spool through any previously-tied portion of the net. On the other hand, the repetitive knots facilitate construction of a netting from one single spool. The improved fastening system does not require the flexible member to be a cable. The flexible member need only be a cord subject to bending and tying to produce knots.

Shown in FIG. 1 are short portions of a main cable 13 which are doubled to form a series of doubled side loops 12. A doubled side loop 12 is then tied to a doubled loop 11 of the previous row, which step of tying consequently forms a new row of loops to which the next row will be anchored.

The doubling of a section of a single and continuous cable 13 forms a functional free "end" 10, where no "end" actually exists, which can then be tied to a previously-formed loop 11 in any desired configuration to produce a netting.

Figure 2:
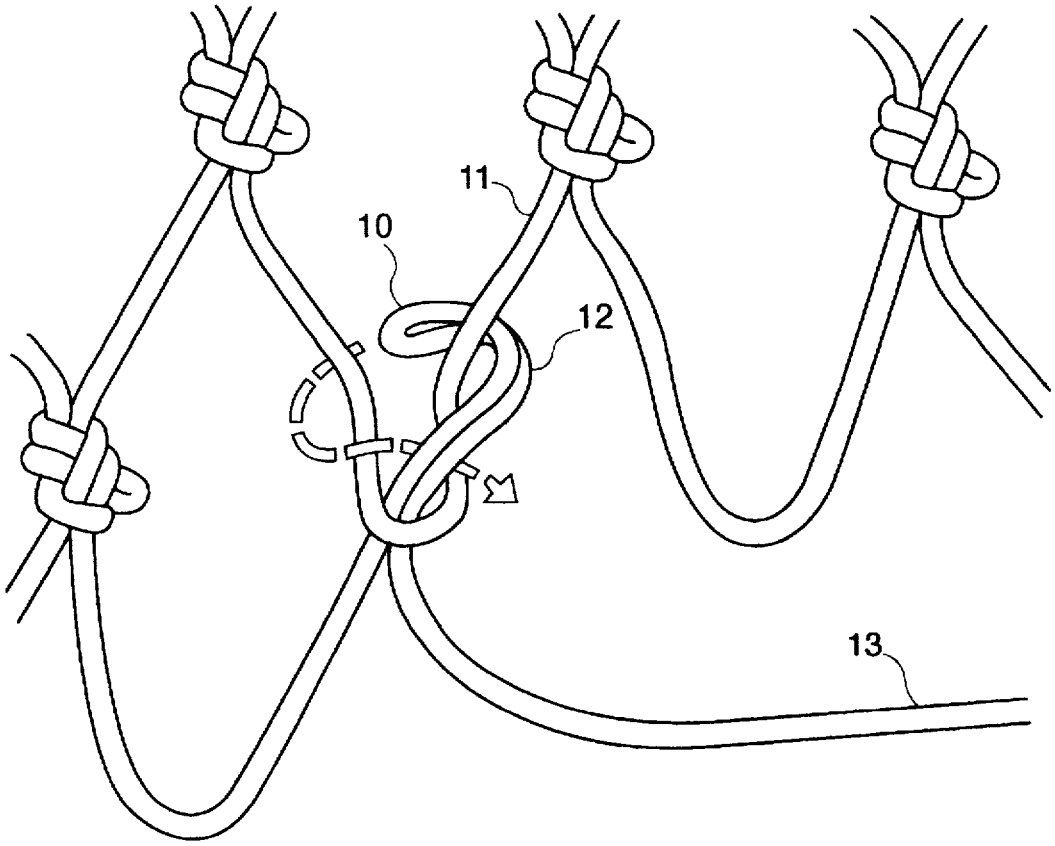
FIG. 2 is a side view of a partially constructed improved cable netting which uses a different knot.

Knotting of a doubled section with an existing loop may take on a different configuration. Shown in FIG. 2 is a netting which uses a different knot. In either instance, the free end 10 may be made to protrude from the knot.

The above improved fastening system has its chief advantage in that it eliminates the need to handle the cable spool during knotting.

A CYLINDRICAL NETTING CONSTRUCTION

To construct a cylindrical netting utilizing the improved fastening system, a main cable is substantially laid in a circle. The forming and knotting path lies substantially on a cylinder. By repeating the group of forming and knotting steps along additional paths which lie on the cylinder, a tubular netting 16 may be generated.

Figure 3:
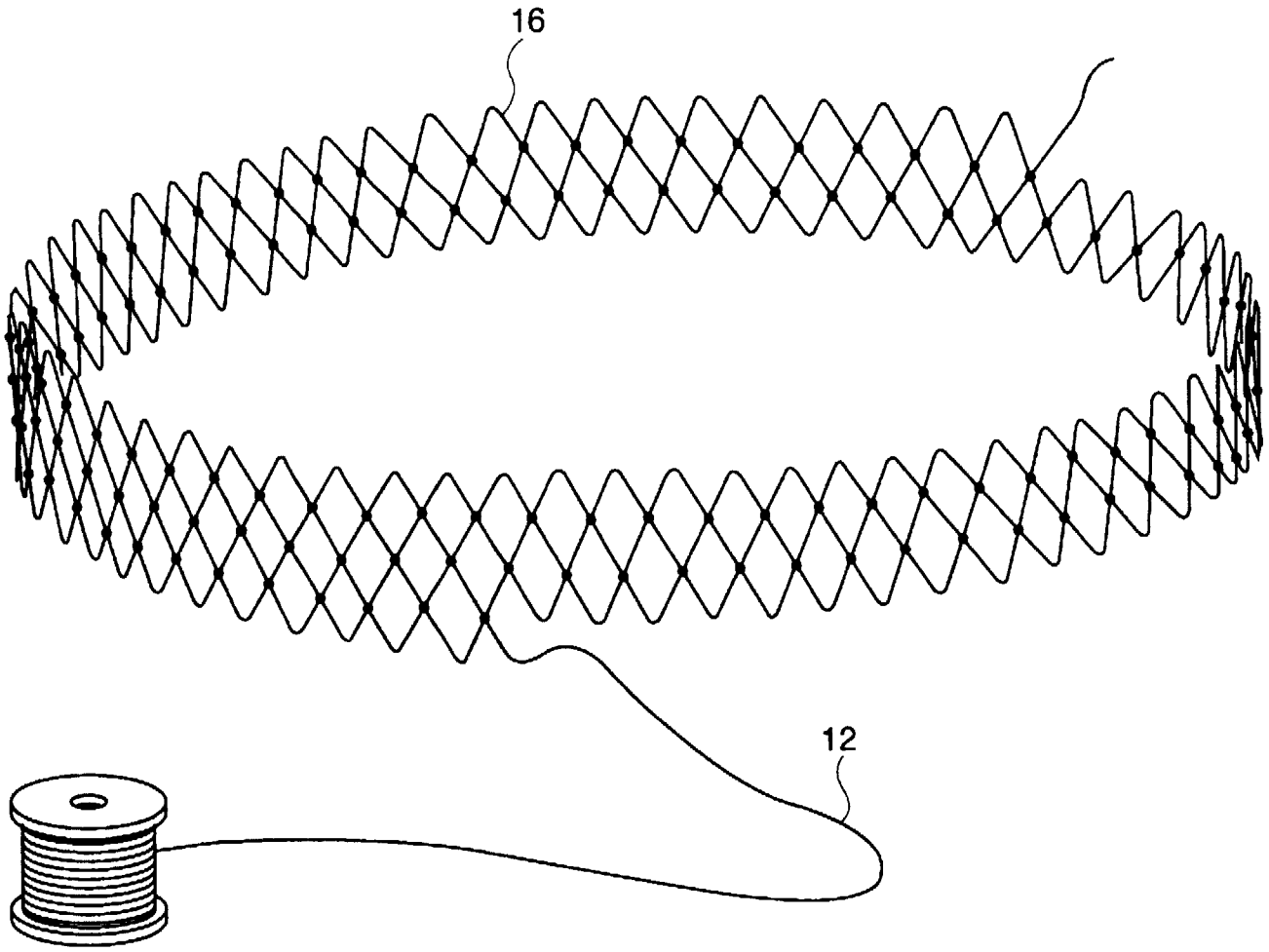
FIG. 3 is a perspective view of a partially constructed cylindrical netting embodiment.

Shown in FIG. 3 is a cylindrical netting in formation. By cutting the tubular netting 16 lengthwise, a square or rectangular netting is produced.

AN ALTERNATIVE BARBED-WIRE STYLE NETTING EMBODIMENT

Figure 4:
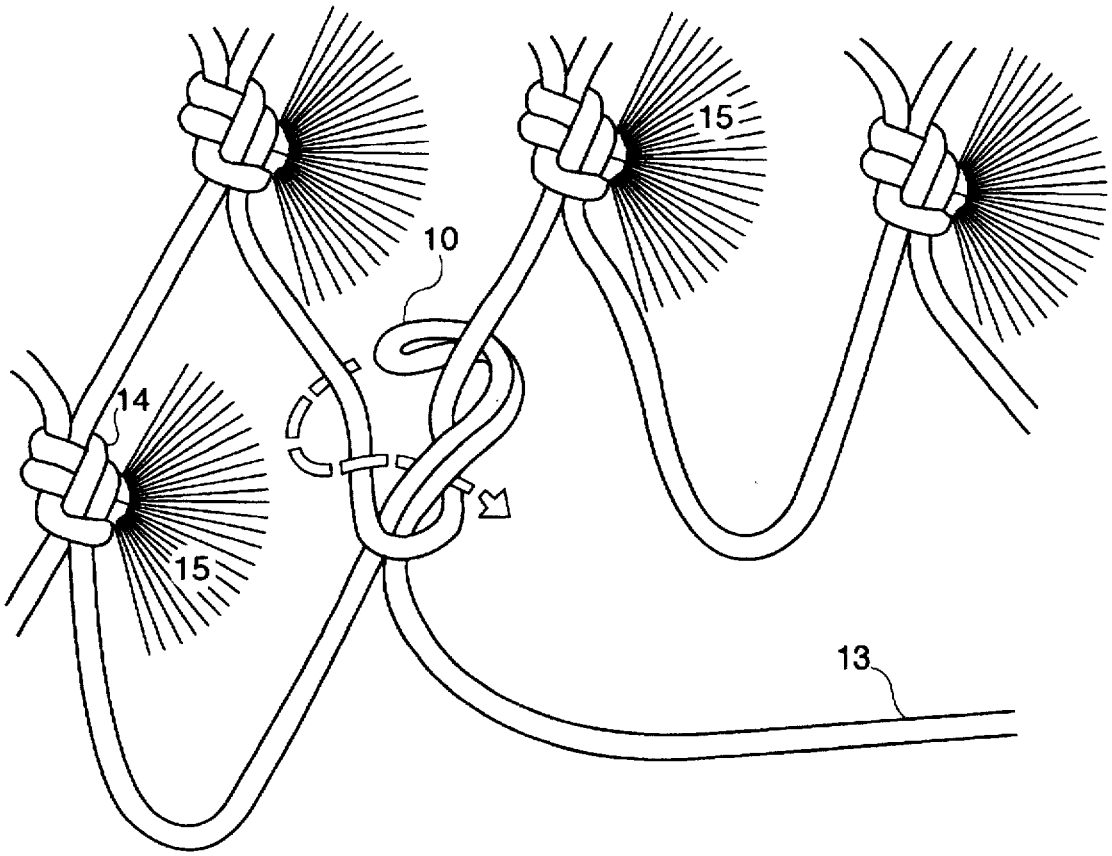
FIG. 4 is a side view of a partially constructed barbed-wire style netting embodiment.

Another possible outgrowth of the improved fastening system for netting, meshes, and the like is an alternative barbed-wire style netting embodiment. As shown in FIG. 4, knots 14 are formed with an extra-long tail, where the tail is the protruding end of a doubled section of a single cable 13. The tips of each tail may be cut for separation, permitting the resulting separated ends to be unraveled. The cuts result in a tuft of radiating, sharp-tipped cable spines 15.

The sharp-tipped cable spines 15, when directed outward from an enclosure, would likely be an effective deterrent to intrusion. Particularly when deployed in a zoo environment, it would deter outside predatory intrusions into zoo confinements.

AN ALTERNATIVE KNOTTED CABLE EMBODIMENT

Alternative efforts to develop a reasonably fast method for tying a cable netting lead to an investigation of overhand knots. Unlike the improved fastening system, these efforts focused on knotting chiefly by hand. In addition, a multiplicity of cable spools were utilized in pairs. Cables were selected from the group shown in Table 1.

The first workable process involved a pair of tall spindles that were fastened to a board. One hundred eight spools of cable were stacked on the left spindle, each adjoining pair of spools designated as alternating "A" and "B" spools, with the first spool on top being the "A" spool. Then, by lifting one pair of spools from the spindle at a time, two cables could be tied together ("A" to "B"), and the spools would then be moved to the empty spindle on the right.

Following this method, the entire stack of spools was tied in pairs and transferred, two at a time, to the right-hand spindle, so that the first "A" spool resulted on the bottom and the last "B" spool resulted on top. Next, the process was repeated in reverse, but the top spool ("B") was transferred back to the left spindle without tying it to the "A" spool below. This caused the next row of knots to be tied "B" to "A," with one non-tied "A" cable left over at the end of the row. By alternating this process repeatedly, a sheet of diamond-patterned netting was created.

The employed method helped to separate the cables and prevent entanglements. By measuring the desired interval from each previous row of knots and then kinking the cables at that location by bending them over the edge of a thin metal blade, each row of knots was placed at the correct spacing.

An improvement to the spindle approach was achieved with the use of a revolving drum, through which protruded a grid of retractable pins. This eliminated time wasted in rotating the racks, and kept the waiting rows of unused pins out of the way while knots were being tied on the active row.

Figure 5:
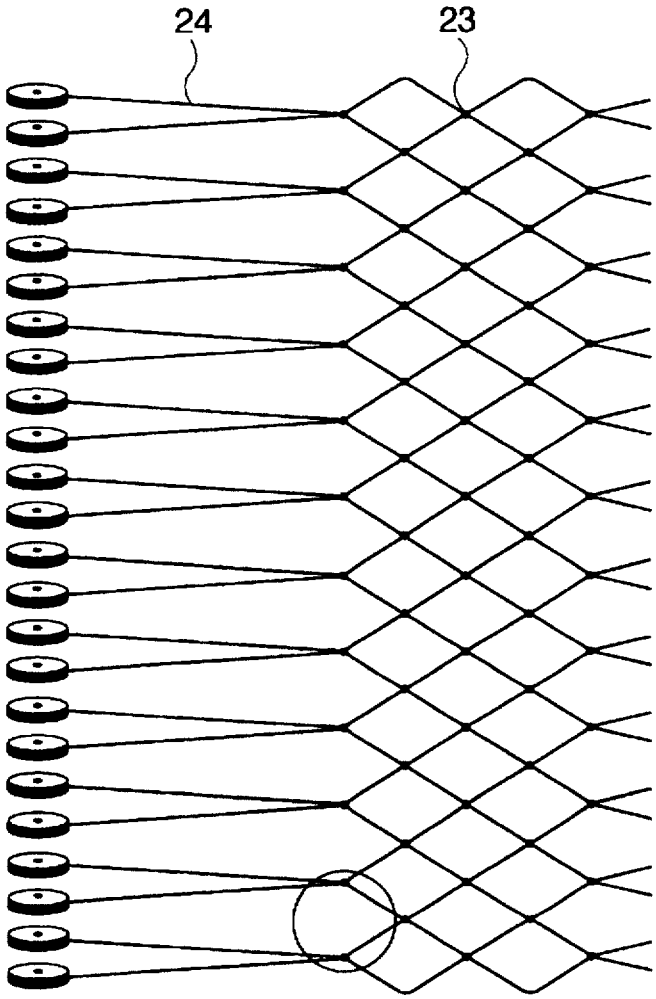
FIG. 5 is a layout of a partially constructed cable netting using regularly patterned peg arrangement.
Figure 6:
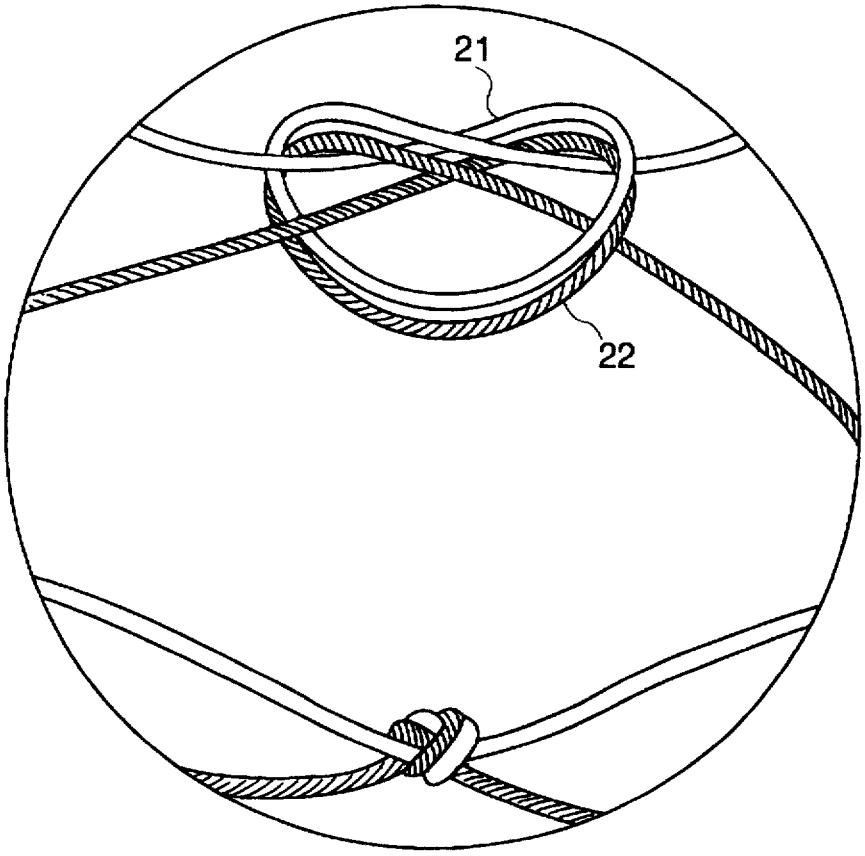
FIG. 6 is a magnified view of a pair of interlocking knots, before and after completion of a knot.

Further improvements were possible in the arrangement of alternate pairing of the spools and keeping them organized. For example, shown in FIG. 5 is a layout of a partially constructed cable netting using regularly patterned peg arrangement. For example, where each one of a regularly patterned peg arrangement is shown, a peg 23 is used to hang the cables 24 to tie the knots 21 and 22. Shown in FIG. 6 is a magnified view of a pair of interlocking knots 21 and 22, before and after completion of a knot. (The peg is not shown.) The resulting netting is the same as would have been produced by utilizing the above manual tying procedure.

Such various modifications may be made in and to the above described embodiment without departing from the spirit and scope of this invention. For example, the basic cable material need not be stainless steel. Any flexible cable material of nonmetallic composition utilizing the disclosed tying techniques would be within the scope of this invention. Furthermore, the tying techniques do show promise of automation, and would be equally applicable in automated production environments.

AN ALTERNATIVE SWIVEL-KNOT EMBODIMENT

Hand-tied interlocking swivel-knotted nettings were conceived mainly to combat cable weakening and breakage associated with efforts to contain animals with nettings having fixedly-tied knots. The fatiguing of prior art nettings was observed due to repeated contacts with animals, which contacts flex and break joints around fixedly-tied knots. The knotting for the swivel-knotted nettings, as conceived, comprises two loosely swiveling knots with respect to each other, which configuration avoids fatiguing of the comprising cables upon repeated animal contacts.

As earlier exemplified, a hand-tied swivel-knot netting may have the larger 3"×3" meshes produced with multiple spools of 175 lbs. tensile strength 7×7 cable. The swivel knots could be tied fairly quickly and will not slip. However, unlike the improved fastening system, numerous cables are required.

Figure 7:
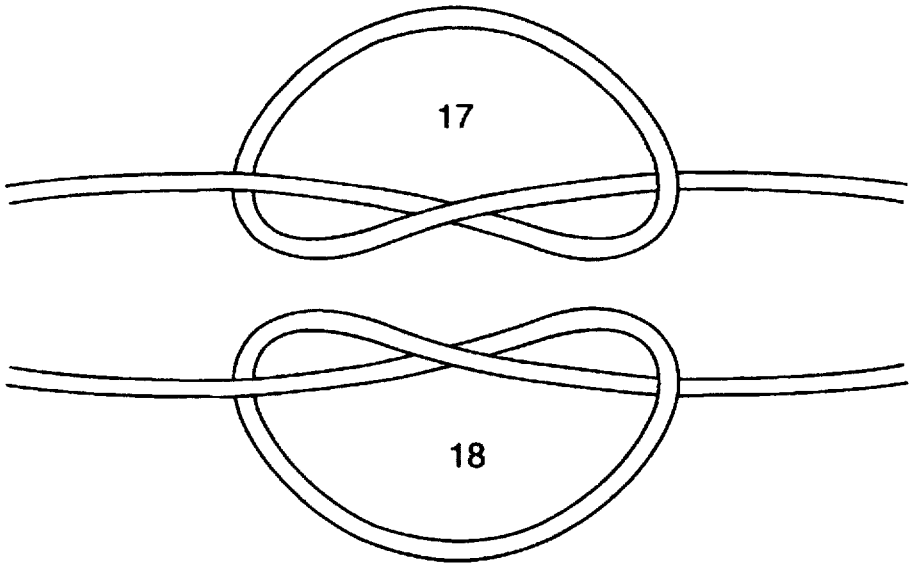
FIG. 7 is a side view of separated upper and lower overhand knots of an alternative swivel-knot embodiment.
Figure 8:
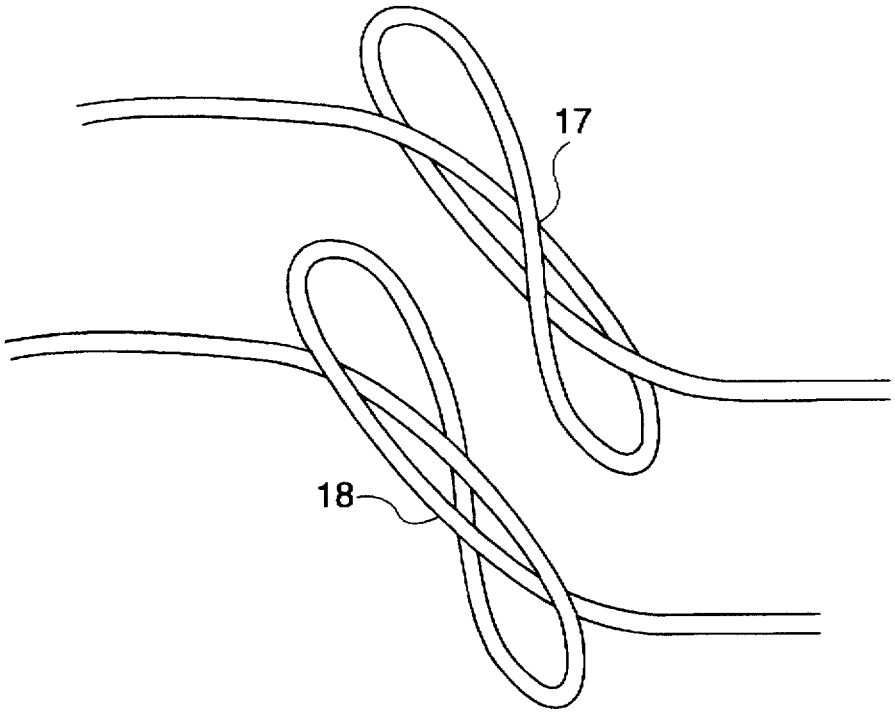
FIG. 8 is a top view of separated upper and lower overhand knots of an alternative swivel-knot embodiment.

Shown in FIG. 7 is a side view of separated upper and lower knots of the present alternative swivel-knot embodiment. Although both upper 17 and lower 18 knots are forms of overhand knots, these knots are tied differently from each other. Shown in FIG. 8 is a top view of separated upper and lower knots of the present swivel-knot embodiment.

Figure 9:
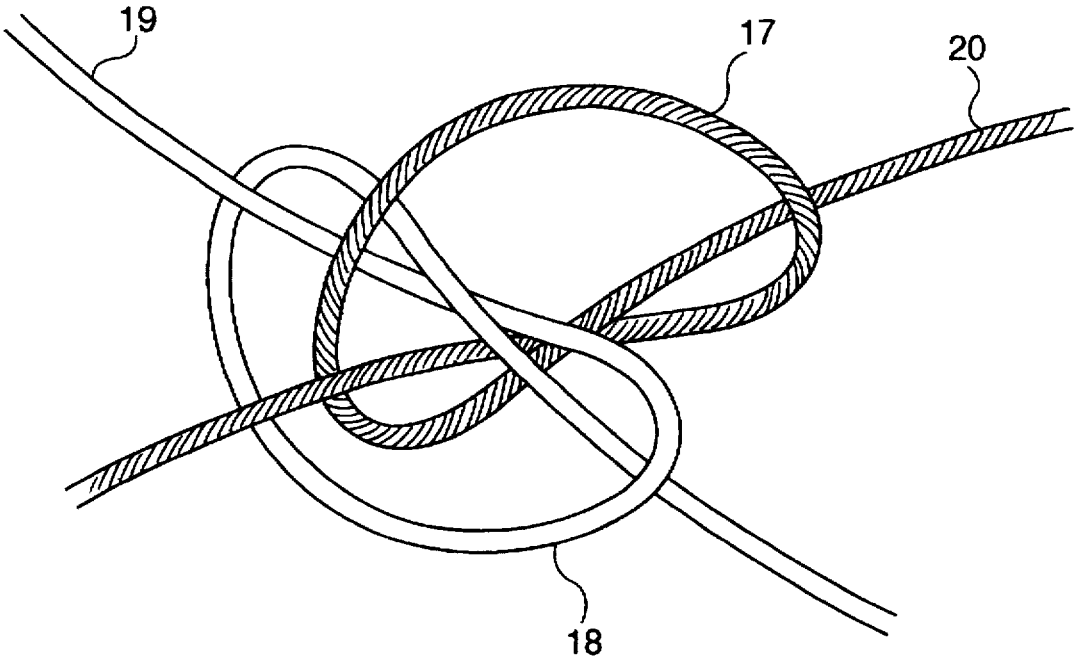
FIG. 9 is a side view of interlocked upper and lower knots of an alternative swivel-knot embodiment.

FIG. 9 is a side view of interlocked upper 17 and lower 18 knots of the present alternative swivel-knot embodiment utilizing cables 19 and 20.

The processes employed in tying the above knots were generally slow and tedious. However, the procedures described are susceptible to automation, and such automation is within the ambit of the present invention.

ALTERNATIVE CRIMPED AND STAPLED NETTING EMBODIMENTS

Other investigations to develop a reasonably fast method for manufacturing a cable netting lead to an investigation of crimped nets. Unlike either of the improved fastening system or the interlocked pairs of swivel knots (overhand knots), crimped cable nets were investigated. The netting material was a 0.027 1×7 Toothy Critter Wire™, manufactured by the Seven Strand Corporation. A regular layout of a plurality of those cables was joined at regular intervals and crimped with a separate connector at each cable joints.

Figure 10:
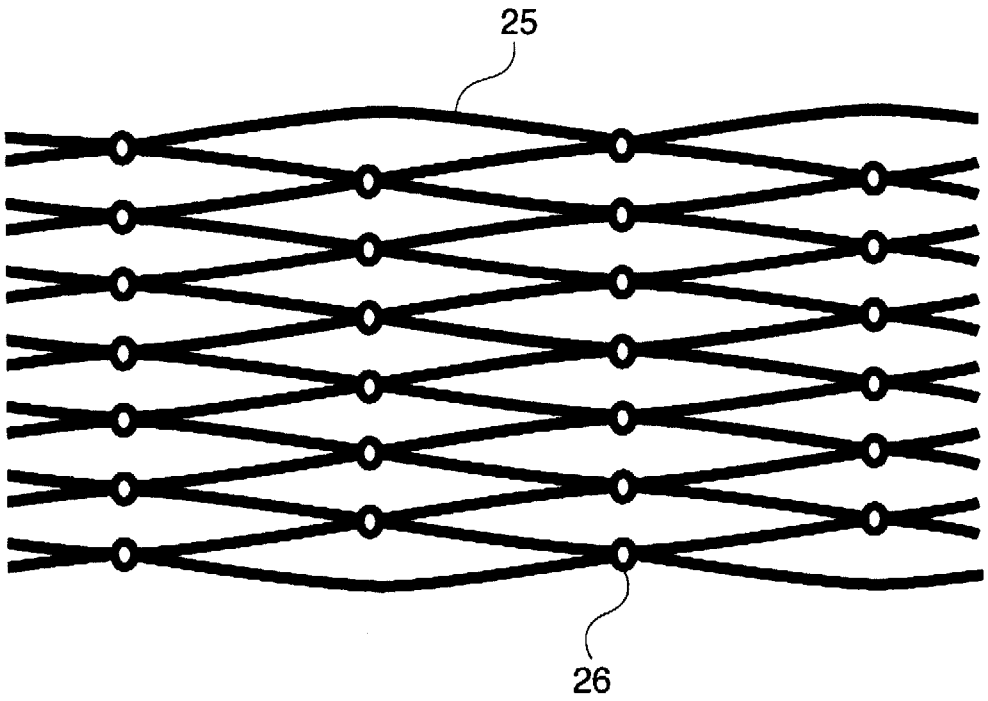
FIG. 10 is an alternate cable netting using staples to form a mesh.

A close variant of a crimped connection is a stapled connection. Shown in FIG. 10 is an alternate cable netting 25 using staples 26 to form a mesh. The staples 26 offer the advantage of manufacturing the netting as a cylinder.

A single, fixed stapling mechanism may be used for production of a stapled netting. A single spool of cable which is wound in a close spiral around a drum may supply a quantity of cable for feeding to the stapling mechanism. Staples are applied at regular intervals as the cable drum rotates past the stapling mechanism.

Figure 11:
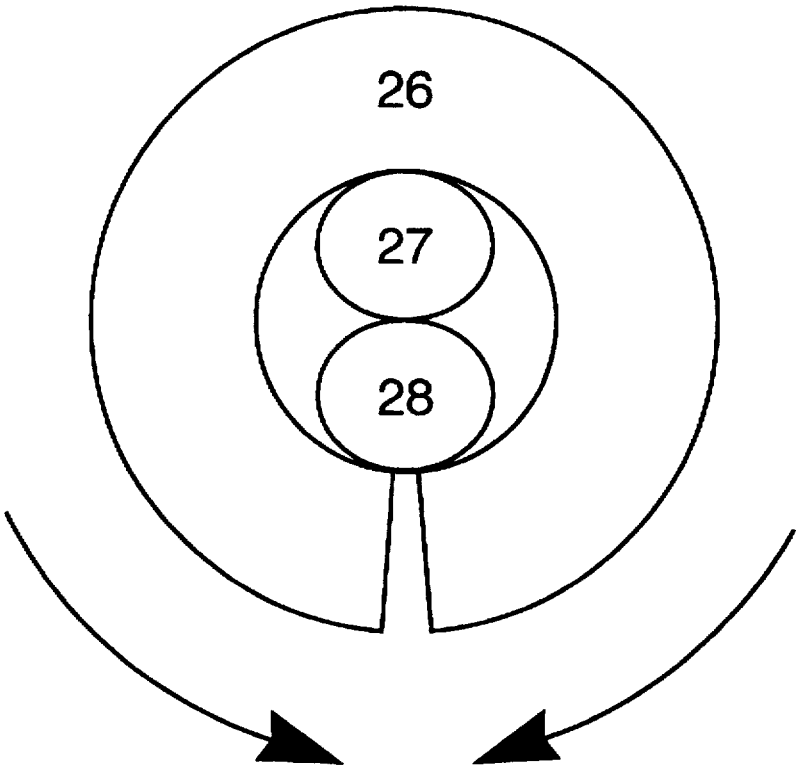
FIG. 11 is a side cut-away profile of an exemplary staple holding a pair of cables.

Shown in FIG. 11 is a cut-away profile of an exemplary staple 26 holding a pair of cables 27 and 28. The staple may overlap when stapled. The size of the staple is small to maintain see-through visibility for finer cables.

It is intended that the forgoing detailed description be regarded as illustrative rather than limiting, and that it be understood that it is the following claims, including all equivalents, which are intended to define the scope of this invention.

What is claimed is:

1. An improved animal barrier material for fixed deployment and having substantial see-through and break-resistant characteristics, comprising:

a plurality of linked meshes composed of one or more cables of fine gauge and having a plurality of mesh-to-mesh connections; and a knot with a doubled end and composed of said one or more cables comprising said linked meshes and securing each of said mesh-to-mesh connection, wherein said knot with a doubled end is formed by:

doubling an existing mesh;

looping said doubled portion of a mesh cable around said doubled existing mesh;

pulling said doubled end of said looped and doubled portion around the looped and doubled portion and through the doubled end of the doubled existing mesh to extrude said doubled end; and securing said doubled end of said looped and doubled portion by pulling said doubled portion against said doubled existing mesh.

2. The improved animal barrier material of claim 1 wherein said plurality of linked meshes form a cable netting substantially cylindrical in shape.

3. The improved animal barrier material of claim 1 wherein said plurality of linked meshes form a cable netting substantially rectilinear in shape.

4. The improved animal barrier material of claim 1 wherein said knot with a doubled end has said doubled end cut, separated, and unravelled, resulting in an overall barbed-wire style of netting.

5. An improved animal barrier material for fixed deployment and having substantial see-through and break-resistant characteristics, comprising:

a plurality of linked meshes composed of one or more cables of fine gauge and having a plurality of mesh-to-mesh connections; and a knot with a doubled end and composed of said one or more cables comprising said linked meshes and securing each of said mesh-to-mesh connection, wherein said knot with a doubled end is formed by:

pulling a doubled portion of a mesh cable adjacent and underneath a cable portion forming an existing mesh;

looping said doubled portion around a periphery of said existing mesh;

pulling said doubled end of said looped and doubled portion in between said existing mesh and said doubled portion to extrude said doubled end; and securing said doubled end in between said existing mesh and said doubled portion by pulling said doubled portion against said existing mesh.

6. An improved fastening system to effectuate a simplified knotting process for producing a superior see-through netting having rows of meshes, comprising the following steps for completing a mesh in the first row of meshes:

doubling a short portion of a continuous cable having a short portion and a second portion to create a doubled side loop;

forming a mesh by placing said doubled short portion of said cable adjacent the second portion of said cable;

looping said doubled short portion of said cable with respect to said second portion; and knotting said doubled short portion in relation to said second portion to secure said mesh.

7. The improved fastening system of claim 6 further comprising the following steps for completing a mesh in the second and higher rows of meshes:

doubling a short portion of said continuous cable having a short portion and at least a row of mesh loops to create a doubled side loop;

forming a mesh in the second or higher row of meshes by placing said doubled short portion of said cable adjacent an existing mesh loop of said cable;

looping said doubled short portion of said cable with respect to said existing mesh loop; and knotting said doubled short portion in relation to said existing mesh loop to secure a new mesh.

8. The improved fastening system of claim 7 wherein said second portion is laid out in a circle.

9. The improved fastening system of claim 7 wherein said step of knotting results in a protruding end of said doubled short portion.

10. The improved fastening system of claim 9 further comprising the steps of:

cutting all of said protruding ends of said doubled short portions;

separating the resulting cut ends; and unravelling the separated cut ends to allow the resulting cut and separated ends to form a barbed-wire style of netting.

11. A knotting process for producing a superior see-through netting having rows of meshes, comprising the following steps:

feeding a plurality of cables each from a respective spool of cable;

stacking said spools of cable on either a left or a right spindle;

arranging the plurality of cables in sequence, each cable being adjacent to another;

choosing pairs of adjacent cables in said arranged sequence, designated an odd set of pairs of cables;

uniformly tying said odd set of pairs of cables to form a sequence of paired and tied cables, designating an odd set of ties;

choosing pairs of adjacent cables in said arranged sequence different from the odd set of pairs of cables, designating an even set of pairs of cables; and uniformly tying said even set of pairs of cables to form a sequence of paired and tied cables at a uniform length removed from said odd set of ties, designating an even set of ties.

12. The knotting process of claim 11, further comprising a step of sequentially transferring a pair of spools of cable from one spindle to another upon tying of a respective pair of cables.

13. A knotting process for producing a superior see-through netting having rows of meshes, comprising the following steps:

feeding a plurality of cables each from a respective spool of cable;

arranging the plurality of cables in sequence, each cable being adjacent to another;

inserting said spools of cable on a grid of retractable pins extending from one or more accessible surfaces of a revolving drum;

orienting said revolving drum so as to have certain of said adjacent cables made available for choosing cable pairs from a fixed position;

choosing pairs of adjacent cables in said arranged sequence designated an odd set of pairs of cables;

uniformly tying said odd set of pairs of cables to form a sequence of paired and tied cables, designating an odd set of ties;

choosing pairs of adjacent cables in said arranged sequence different from the odd set of pairs of cables, designating an even set of pairs of cables; and uniformly tying said even set of pairs of cables to form a sequence of paired and tied cables at a uniform length removed from said odd set of ties, designating an even set of ties.

14. A knotting process for producing a superior see-through netting having rows of meshes, comprising the following steps:

feeding a plurality of cables each from a respective spool of cable;

arranging the plurality of cables in sequence, each cable being adjacent to another;

choosing pairs of adjacent cables in said arranged sequence, designated an odd set of pairs of cables;

uniformly tying said odd set of pairs of cables to form a sequence of paired and tied cables, designating an odd set of ties, choosing pairs of adjacent cables in said arranged sequence different from the odd set of pairs of cables, designating an even set of pairs of cables; and uniformly tying said even set of pairs of cables to form a sequence of paired and tied cables at a uniform length removed from said odd set of ties, designating an even set of ties, wherein each of said tying of even and odd sets of pairs of cables further comprises the steps of, laying the adjacent cables straight and in a parallel direction on a surface having regularly patterned placements of protruding pegs, which regularly patterned placements have rows of pegs formed in the direction of the straight adjacent cables;

aligning each one of straight adjacent cables in between a nearest straight pair of rows of pegs; and tying a pair of adjacent cables using the closest peg in the regularly patterned protruding placements of pegs to hang said adjacent cables and use as a pattern marker to form a regularly patterned netting.

* * * * *